US008143813B2

(12) United States Patent
Aarts

(10) Patent No.: US 8,143,813 B2
(45) Date of Patent: Mar. 27, 2012

(54) DATA BASED AMBIENT LIGHTING CONTROL

(75) Inventor: Ronaldus Maria Aarts, Geldrop (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 445 days.

(21) Appl. No.: 12/294,624

(22) PCT Filed: Mar. 27, 2007

(86) PCT No.: PCT/IB2007/051076

§ 371 (c)(1),
(2), (4) Date: Sep. 26, 2008

(87) PCT Pub. No.: WO2007/113739

PCT Pub. Date: Oct. 11, 2007

(65) Prior Publication Data

US 2010/0231140 A1 Sep. 16, 2010

Related U.S. Application Data

(60) Provisional application No. 60/788,469, filed on Mar. 31, 2006, provisional application No. 60/867,602, filed on Nov. 29, 2006.

(51) Int. Cl.
*H05B 37/00* (2006.01)
*H05B 37/02* (2006.01)

(52) U.S. Cl. ..... 315/307; 315/312; 315/318; 362/227; 362/459; 362/602

(58) Field of Classification Search ..... 315/307, 315/312, 318, 363, 291; 362/227; 345/175, 345/207, 468

See application file for complete search history.

(56) References Cited

U.S. PATENT DOCUMENTS

| | | | | |
|---|---|---|---|---|
| 6,016,038 | A * | 1/2000 | Mueller et al. | 315/291 |
| 6,211,626 | B1 * | 4/2001 | Lys et al. | 315/291 |
| 6,548,967 | B1 * | 4/2003 | Dowling et al. | 315/318 |
| 6,611,297 | B1 | 8/2003 | Akashi et al. | |
| 7,202,613 | B2 * | 4/2007 | Morgan et al. | 315/312 |
| 7,231,060 | B2 * | 6/2007 | Dowling et al. | 382/100 |
| 7,309,965 | B2 * | 12/2007 | Dowling et al. | 315/318 |
| 7,550,931 | B2 * | 6/2009 | Lys et al. | 315/291 |
| 2002/0038157 | A1 | 3/2002 | Dowling et al. | |
| 2004/0160199 | A1 * | 8/2004 | Morgan et al. | 315/312 |

FOREIGN PATENT DOCUMENTS

| | | | |
|---|---|---|---|
| DE | 10252698 | * | 8/2004 |
| DE | 10252698 | B3 | 8/2004 |
| WO | 2006003602 | A | 1/2006 |

* cited by examiner

*Primary Examiner* — Vibol Tan

(57) ABSTRACT

In controlling an ambient lighting element, a category of data being rendered by a host is identified, ambient lighting data associated with the identified category is retrieved, and the retrieved ambient lighting data is rendered in correspondence with the rendered data. The retrieved ambient lighting data may be an ambient light script arranged to determine temporal portions of ambient lighting data. The ambient lighting data may be associated with the category based on user input. A sub-category of the data may be identified and the retrieved ambient lighting data may be modified with additional ambient lighting data associated with the sub-category. An association of a category with ambient lighting data may be edited by a user. A default association of a category to ambient lighting data may be provided.

18 Claims, 3 Drawing Sheets

DATA BASED AMBIENT LIGHTING CONTROL

This application claims the benefit of U.S. Provisional Patent Application No. 60/788,469, filed Mar. 31, 2006.

The present system relates to ambient lighting effects that accompany rendering of data.

Koninklijke Philips Electronics N.V. (Philips) and other companies have disclosed means for changing ambient or peripheral lighting to enhance video content for typical home or business applications. Ambient lighting modulated by video content that is provided together with a video display or television has been shown to reduce viewer fatigue and improve realism and depth of experience. Currently, Philips has a line of televisions, including flat panel televisions with ambient lighting, where a frame around the television includes ambient light sources that project ambient light on the back wall that supports or is near the television. Further, light sources separate from the television may also be modulated relative to the video content to produce ambient light that may be similarly controlled.

In a case of a single color light source, modulation of the light source may only be a modulation of the brightness of the light source. A light source capable of producing multi-color light provides an opportunity to modulate many aspects of the multi-color light source based on rendered video including a wide selectable color range per point.

It is an object of the present system to overcome disadvantages in the prior art and/or to provide an ambient lighting effect that may not be directly related to the content of rendered video.

The present system provides a method, program and device for controlling an ambient lighting element. In accordance with an embodiment, a category of data being rendered by a host is identified, ambient lighting data associated with the identified category is retrieved, and the retrieved ambient lighting data is rendered in correspondence with the rendered data. The retrieved ambient lighting data may be an ambient light script arranged to determine temporal portions of ambient lighting data. The ambient lighting data may be associated with the category based on user input. Categories may include news, traffic, and weather.

A sub-category of the data may be identified and the retrieved ambient lighting data may be modified with additional ambient lighting data associated with the sub-category. An association of a category with ambient lighting data may be edited by a user. A default association of a category to ambient lighting data may be provided.

The present system is explained in further detail, and by way of example, with reference to the accompanying drawings wherein.

The following are descriptions of illustrative embodiments that when taken in conjunction with the following drawings will demonstrate the above noted features and advantages, as well as further ones. In the following description, for purposes of explanation rather than limitation, specific details are set forth such as the particular architecture, interfaces, techniques, etc., for illustration. However, it will be apparent to those of ordinary skill in the art that other embodiments that depart from these specific details would still be understood to be within the scope of the appended claims. Moreover, for the purpose of clarity, detailed descriptions of well-known devices, circuits, and methods are omitted so as not to obscure the description of the present system.

It should be expressly understood that the drawings are included for illustrative purposes and do not represent the scope of the present system.

Figure 1:
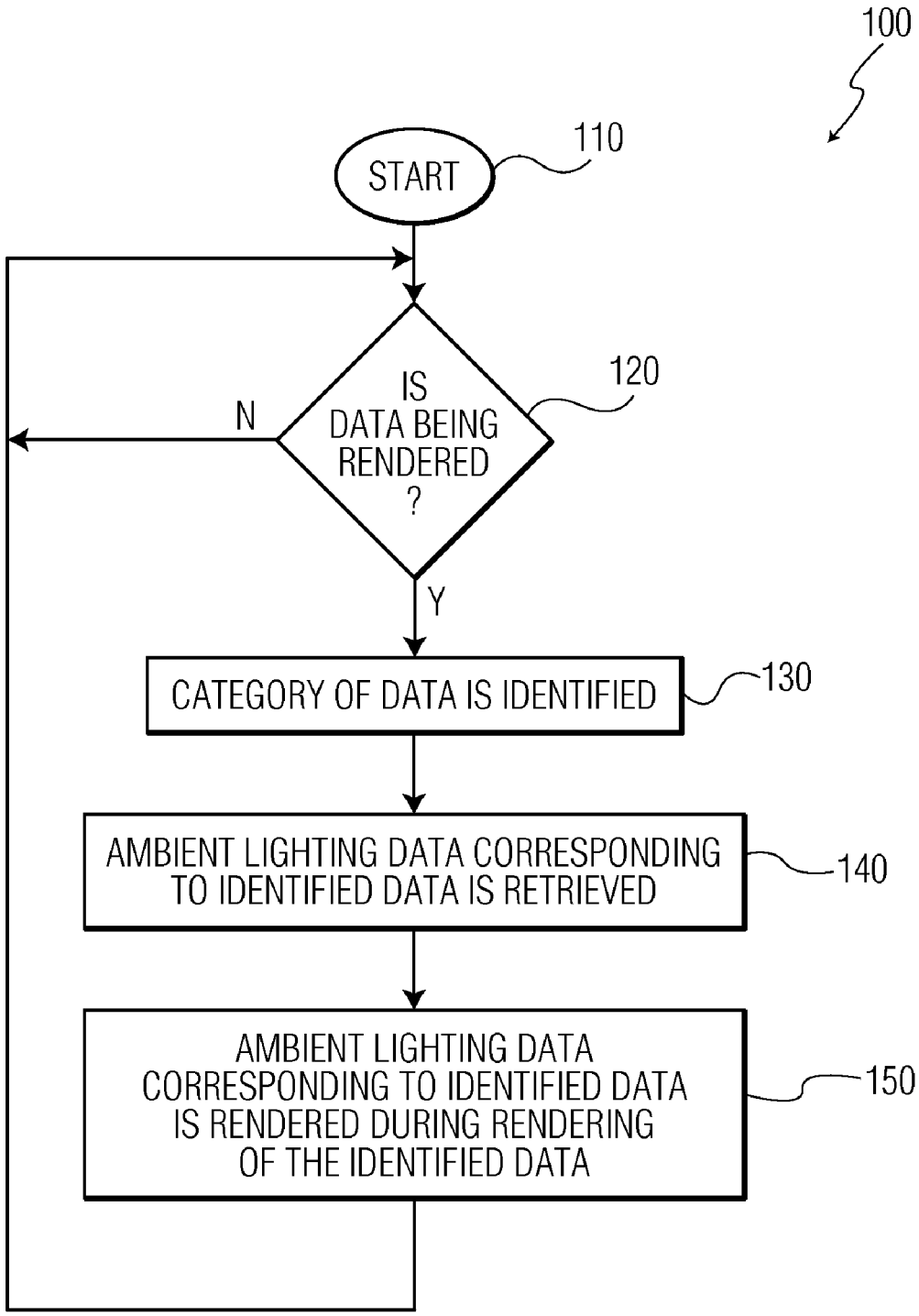
FIG. 1 shows a flow diagram in accordance with an embodiment of the present system.

FIG. 1 shows a flow diagram 100 in accordance with an embodiment of the present system. During act 110, the process begins which may occur as a result of activation, such as turning on, of an ambient lighting host. As used herein, the term ambient lighting host, or simply host is intended to include a device that has features and/or characteristics that are unrelated to production of ambient lighting. For example, a television, a monitor, a personal digital assistant (PDA), cell phone, appliance, and other devices that have an ability to render text data all may be considered a host. The host may include an ambient lighting system in accordance with an embodiment of the present system or may simply be operably coupled to such an ambient lighting system. Act 110 may also occur due to an activation of an ambient lighting feature by a user of the host. For example, the user may decide at some point in time to activate or reactivate the ambient lighting feature in accordance with an embodiment of the present system. Naturally the ambient lighting feature may default to an on-state without user intervention or action. Naturally act 110 may also provide a switch between a video-based ambient lighting process and a data-based ambient lighting process as described herein. In one embodiment, this switch between processes may be based on an identification by the host of the type of data (e.g., video or text based) being rendered by the host.

In any case, during act 120, the system in accordance with an embodiment enters a waiting state to determine if data is being rendered. The term "data" as utilized herein is intended to include teletext, computer data, web-pages including combined textual and graphical web-pages, close-captioning text and other data of the like.

In accordance with the present system, following detection that the host is rendering data or is about to render data, the present system identifies a category of the data during act 130. Data typically may be identified as belonging to particular categories of data such as news, traffic, weather, etc. In accordance with an embodiment, the data may have metadata associated with the data that identifies the category. In accordance with a further embodiment, the data being rendered may be analyzed directly to identify the category and/or to identify additional information related to the category including information related to a sub-category. For example, in one embodiment, a category of weather data may be identified for example through associated metadata. Thereafter, the weather data may be automatically scrutinized to identify details of the weather data, such as related to a particular forecast present in the weather data. The scrutinizing may be simply an identification of key words within the data, such as rain, snow, sun, etc., or may be more complex such as identifying iconic representations contained within the data (icon showing clouds with rain, etc.), identifying sequences and/or multiple portions of data to discern a category or details about an identified category. For example, an identification of the keyword rain and an indication related to a measure indicating an amount of rain (e.g., inches, centimeters, etc.), may be utilized for retrieving corresponding ambient lighting data during act 140 in accordance with the present system. To simplify the discussion contained herein, the term category is intended to convey general information related to data as well as more detailed information such as a sub-category, unless specifically stated otherwise.

For an embodiment wherein the data is teletext data, a most significant digit of a teletext page may identify a category of the teletext data. A next most significant digit identifies a sub-category of the teletext data. For example, first digit may identify a category of "sports" while a next most significant digit may identify a sub-category of "regional sports". In this embodiment, each next most significant digit may identify a further sub-category of the teletext data. Regardless of how the category and/or details related to the category of the data are determined, the system in accordance with an embodiment retrieves lighting data, such as a light script that corresponds to the category, sub-category, etc. during act 140. Light scripts that are related to video of an audio/visual host that are produced internal or external to the host are known, such as disclosed in International Patent Application Serial No. IB2006/053524 filed on Sep. 27, 2006, which is assigned to the assignee hereof, the contents of which are incorporated herein by reference in its entirety. The light script is rendered to control an ambient lighting effect, such as defining and/or altering an ambient lighting color, hue, saturation, brightness, intensity, rate of change, etc. and/or other characteristics of the ambient lighting effect of one or more ambient lighting elements.

In accordance with the present system, ambient lighting data, such as a light script, is arranged to correspond to data categories and/or sub-categories. In one embodiment, a table of categories, sub-categories, etc. may be stored that are accessible to the ambient lighting system. The table may contain a list of categories, sub-categories, etc. and ambient lighting data such as light scripts that correspond to the categories. The system in accordance with an embodiment utilizes the association, such as may be stored in the table, and the identified category to identify and retrieve ambient lighting data that corresponds to the category.

In one embodiment in accordance with the present system, the ambient lighting data may simply set one or more given ambient lighting characteristics (e.g., color of an ambient lighting effect) to correspond to the category. In a further embodiment, the ambient lighting data may correspond to a light script that determines a temporal sequence of lighting effects when rendered. For example, for an identified weather sub-category corresponding to a weather forecast including lightning storms, a lighting script including flashing lights may be associated with this sub-category and/or be identified in the table.

During act 150, the present system renders the corresponding light script associated with the data rendered by the host. Rendering the associated light script results in production of an ambient lighting effect under control of the light script. The rendering of the light script may adjust and/or set an ambient lighting effect such as defining and/or altering an ambient lighting color, intensity, duration, and/or other characteristics of one or more ambient lighting elements of the present ambient lighting system. In one embodiment, the light script may define a sequence of pre-edited lighting effects that occur as a result of the rendering of the light script.

In accordance with the present system, as a user moves from one category of data to another category, an ambient lighting effect will change to reflect each rendered data category. In this way, the ambient lighting effect may be identified to facilitate identification of the data category and thereby, provide an aid in the navigation of the data and corresponding categories.

In accordance with an embodiment, a category may be associated with one or characteristics of an ambient lighting effect and further details of the category (e.g., identification of a sub-category) may modulate a same or further characteristic or characteristics of the ambient light effect. For example, an ambient lighting color may be set by a category of rendered data while an intensity of the ambient lighting color may be determined by the sub-category.

In one embodiment, further data or metadata may be associated with the data that may be utilized to modify the ambient lighting data retrieved during 140 and thereby, this further data or metadata may be understood to represent a sub-category as utilized herein. For example, for data such as teletext, additional data, for example indicating an importance of the teletext data, freshness (e.g., recently added) of the teletext data, etc. may be treated as a sub-category in accordance with an embodiment of the present system. In this embodiment, the system may render one or more ambient lighting characteristics such as color, hue, intensity, etc., in response to the data category, but these one or more characteristics may be altered if the news is identified as important (e.g., a hot story), was recently posted and/or recently occurred, etc. For example, an associated ambient lighting effect for a given category (e.g., important news) may be a red ambient lighting effect. In one embodiment if this important news category had a sub-category of recent news, the ambient lighting effect may be modified to be brighter red and/or modified to flash red. In this way, both the category and sub-category may be utilized to identify the associated ambient lighting effect. In this embodiment, the sub-category identified in the table need not be associated with a particular category. For example, the sub-category of recent data may be utilized to modify other categories besides important news. For example, perhaps the category of sports data generally results in a constant blue ambient lighting color. The sub-category of recent news may modify the ambient lighting effect to be brighter blue and/or modified to flash blue. In this way, the sub-category may be utilized to modify more than one category of ambient lighting effect and therefore need not be directly associated with a given identified category.

Further modifications may readily occur to a person of ordinary skill in the art and are intended to be encompassed by the present system. In this way, a data category may be associated with a given light script and/or rate of rendering the given light script in accordance with the present system to produce ambient lighting data including data to control ambient lighting characteristics such as hue, saturation, brightness, color, intensity, rate of change, etc. of one or more ambient lighting elements.

In accordance with an embodiment, default associations of a category to lighting data may reside in the table initially. These associations may be modified in accordance with an embodiment of the present system. In another embodiment, categories may be identified in the table without associated lighting data. In any event, associations may be made and/or modified in accordance with the present system.

Figure 2:
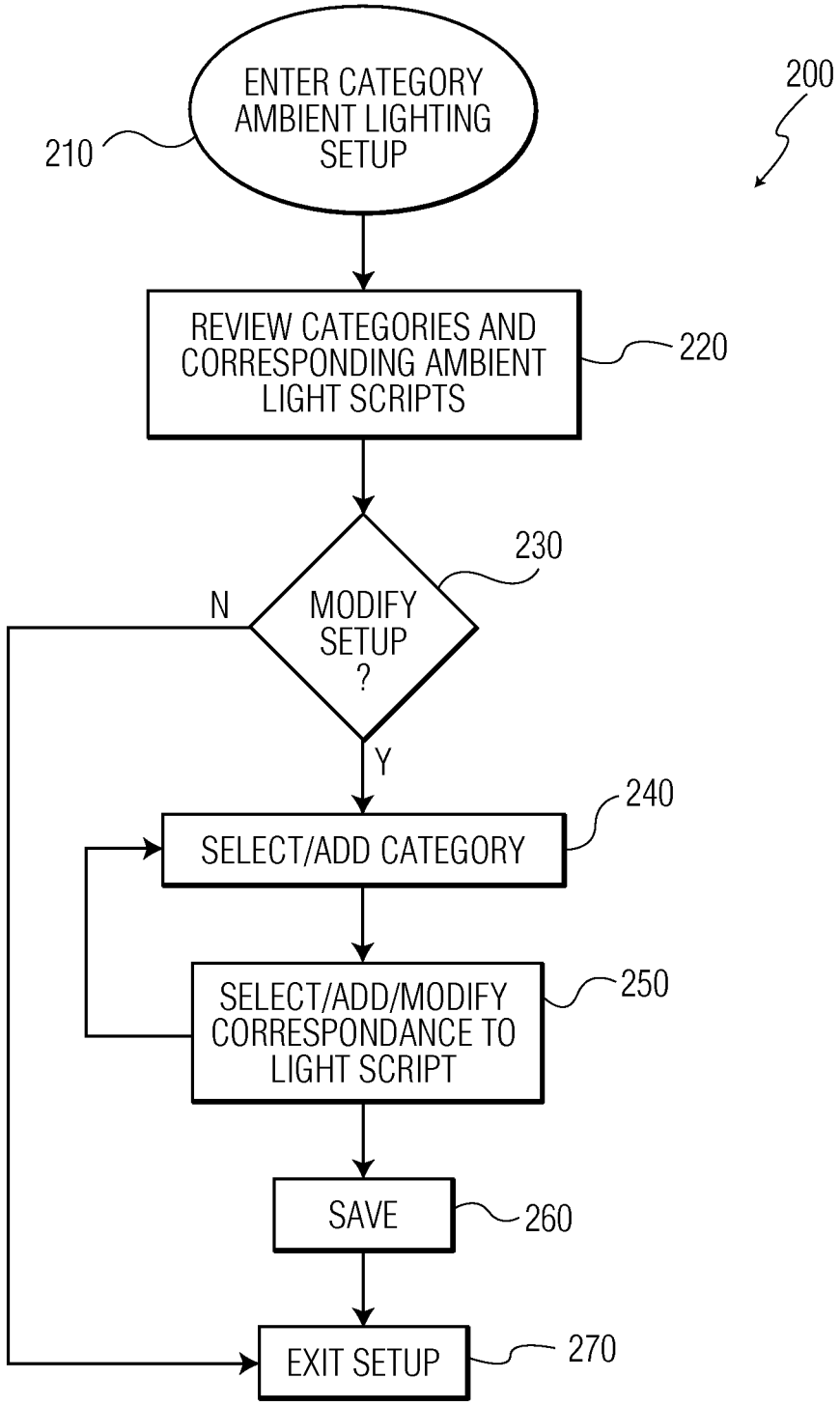
FIG. 2 shows a flow diagram in accordance with an embodiment of the present system.

FIG. 2 shows a flow diagram 200 illustrating editing operations of a table of categories and associated ambient lighting data (e.g., light scripts) in accordance with an embodiment of the present system. During act 210, a user manipulates a user interface in accordance with an embodiment to enter a portion of the user interface for editing the table. The table is reviewed during act 220 including categories and corresponding ambient lighting data, such as data identifying corresponding light scripts.

In one embodiment, the table may have a default set of categories and associated light scripts that may be determined by a manufacturer of such a host device. In this and/or an alternate embodiment, an association may be made and/or altered manually by the user as described further herein.

The user may, such as after some review of the table, make a determination whether to modify the table during act 230. Should the user decide to not modify the table, then the portion of the host user interface for editing the table is exited during act 270. Should the user decide to modify the table during act 230, the user is provided an opportunity to select and/or add a category during act 240. Should the user decide to modify the association portion of the table, then during act 250, the user may select, add and/or modify an ambient lighting data association with the selected/added category. For example, the user may select an association for a category to a light script, wherein the category has no prior association. The user may alter an association by selecting a different light script for association with an exiting category. In one embodiment, a category may be associated with a selected light script by default prior to a manipulation by the user. An association of a particular light script to data category, whether a default association or otherwise, may be overridden by the user. In this way, a user is provided an opportunity to select, add and/or modify particular associations when desired.

The process of modifying correspondence of categories to ambient lighting data such as a light script may be repeated until a determination is made to save the table during act 260. The process may be ended during act 270.

Figure 3:
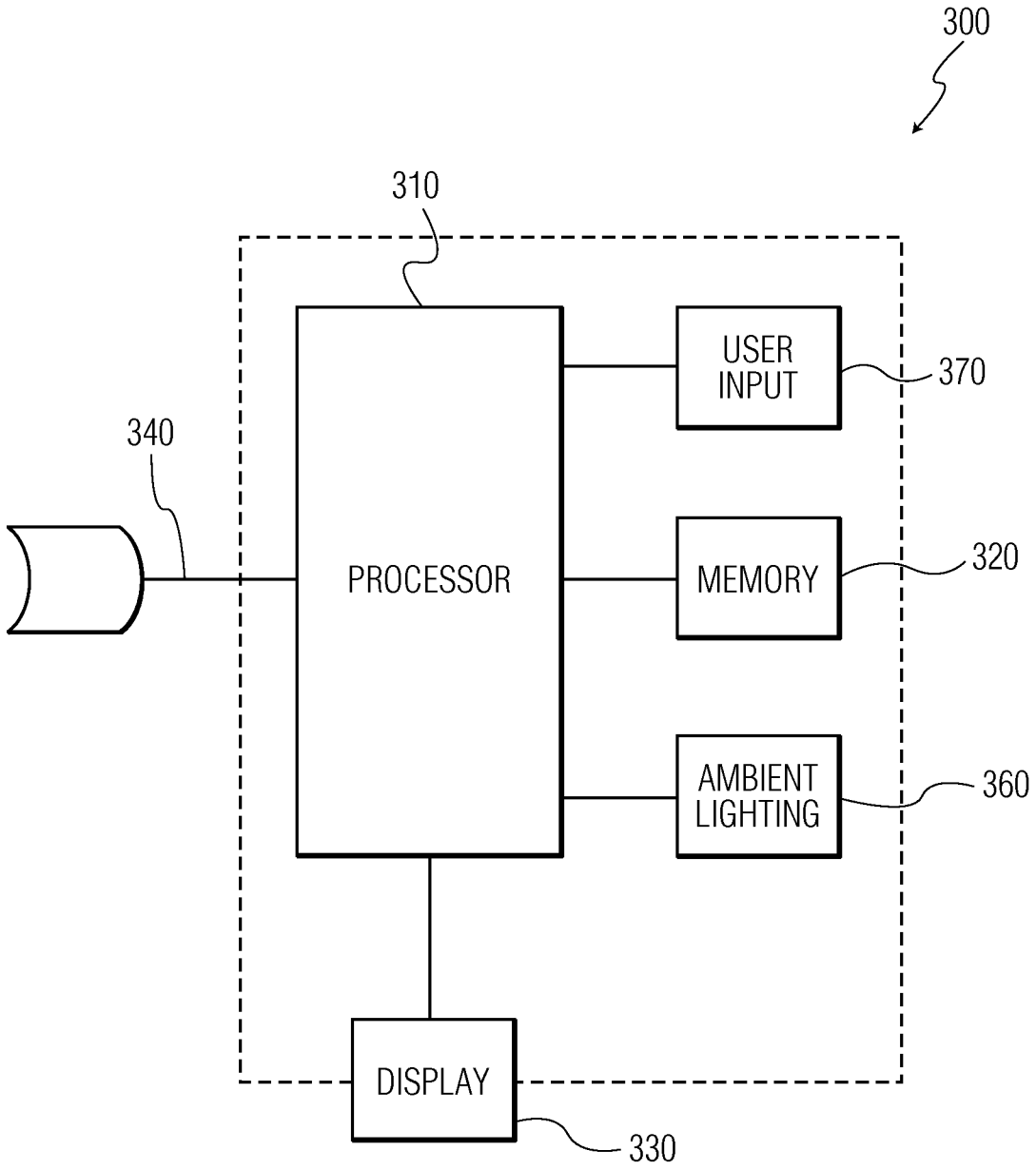
FIG. 3 shows a device in accordance with an embodiment of the present system.

FIG. 3 shows a device 300 in accordance with an embodiment of the present system. The device 300 may have a processor 310 operationally coupled to a memory 320, one or more ambient lighting elements 360, an input/output (I/O) 340 and a user input device 370. The device 300 may be stand-alone, such as an ambient lighting element, wherein it is operationally coupled to a host, or the device 300 may be partially or wholly incorporated into the host. The device 300 may have a display 330 for interacting within a user interface paradigm supporting operation of the present system as described herein. In an embodiment wherein the device 300 is incorporated into the host, the display 330 may be a display that has additional or separate functionality to support features of the host.

The memory 320 may be any type of device for storing application data as well as other data, such as ambient lighting data, a category/ambient lighting data table, light scripts, host data (e.g., in an integrated application), etc. The application data and other data are received by the processor 310 for configuring the processor 310 to perform operation acts in accordance with the present system. The operation acts include rendering ambient lighting data such as a light script to control one or more of the ambient lighting elements 360 to display ambient lighting effects in accordance with the present system. The user input 370 may include a keyboard, mouse, or other devices, including touch sensitive displays, which may be stand alone or be a part of a system, such as part of a personal computer, personal digital assistant, and display device such as a television, for communicating with the processor 310 via any type of link, such as a wired or wireless link. For example, the user input 370 may be utilized for editing the category and ambient lighting data table. Clearly the processor 310, memory 320, display 330, ambient lighting element 360 and/or user input 370 may all or partly be a portion of a television platform, such as a stand-alone television, may be a portion of another host device, or may be standalone devices.

The methods of the present system are particularly suited to be carried out by a computer software program, such computer software program preferably containing modules corresponding to the individual steps or acts of the methods. Such software may of course be embodied in a computer-readable medium, such as an integrated chip, a peripheral device or memory, such as the memory 320 or other memory coupled to the processor 310.

The computer-readable medium and/or memory 320 may be any recordable medium (e.g., RAM, ROM, removable memory, CD-ROM, hard drives, DVD, floppy disks or memory cards) or may be a transmission medium (e.g., a network comprising fiber-optics, the world-wide web, cables, or a wireless channel using time-division multiple access, code-division multiple access, or other radio-frequency channel). Any medium known or developed that can provide information suitable for use with a computer system may be used as the computer-readable medium and/or memory 320.

The memory 320 configures processor 310 to implement the methods, operational acts, and functions disclosed herein. The memory may be distributed or local and the processor 310, where additional processors may be provided, may also be distributed, as for example based within the ambient lighting elements, or may be singular. The memories may be implemented as electrical, magnetic or optical memory, or any combination of these or other types of storage devices. Moreover, the term "memory" should be construed broadly enough to encompass any information able to be read from or written to an address in the addressable space accessed by a processor. With this definition, information on a network is still within memory 320, for instance, because the processor 310 may retrieve the information from the network for operation in accordance with the present system.

The processor 310 is capable of providing control signals and/or performing operations in response to input signals from the user input 370 and executing instructions stored in the memory 320. The processor 310 may be an application-specific or general-use integrated circuit(s). Further, the processor 310 may be a dedicated processor for performing in accordance with the present system or may be a general-purpose processor wherein only one of many functions operates for performing in accordance with the present system. The processor 310 may operate utilizing a program portion, multiple program segments, or may be a hardware device utilizing a dedicated or multi-purpose integrated circuit.

The I/O 340 may be utilized for manipulations within a user interface paradigm as may be readily appreciated and/or for other operations as described above. For example, the I/O 340 may operate to enable a user to enter and modify the category/ambient lighting data table.

Of course, it is to be appreciated that any one of the above embodiments or processes may be combined with one or more other embodiments or processes or be separated in accordance with the present system.

Finally, the above-discussion is intended to be merely illustrative of the present system and should not be construed as limiting the appended claims to any particular embodiment or group of embodiments. Thus, while the present system has been described with reference to exemplary embodiments, it should also be appreciated that numerous modifications and alternative embodiments may be devised by those having ordinary skill in the art without departing from the broader and intended spirit and scope of the present system as set forth in the claims that follow. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise; and h) no specific sequence of acts or steps is intended to be required unless specifically indicated.

The invention claimed is:

1. A method of controlling an ambient lighting element, the method comprising acts of:

identifying a category of data being rendered by a host, wherein the identified category conveys (i) general information related to the data, as well as (ii) more detailed information related to a sub-category;

retrieving ambient lighting data associated with the identified category, wherein retrieving ambient lighting data further includes retrieving additional ambient lighting data associated with the sub-category; and rendering the retrieved ambient lighting data in correspondence with the rendered data, wherein rendering the retrieved ambient lighting data further includes modifying the retrieved ambient lighting data with the additional ambient lighting data associated with the sub-category.

2. The method as claimed in claim 1, wherein the retrieved ambient lighting data is an ambient light script arranged to determine temporal portions of ambient lighting data.

3. The method as claimed in claim 1, wherein said method further comprises an act of:

associating the ambient lighting data with the category.

4. The method as claimed in claim 1, wherein the category is one of news, traffic, and weather.

5. A method of controlling an ambient lighting element, the method comprising acts of:

identifying a category of data being rendered by a host;

retrieving ambient lighting data associated with the identified category; and rendering the retrieved ambient lighting data in correspondence with the rendered data, wherein the category is one of news, traffic, and weather, wherein said method further comprises an act of:

identifying a sub-category of the data, and wherein the act of retrieving comprises an act of modifying the retrieved ambient lighting data with additional ambient lighting data associated with the sub-category.

6. A method of controlling an ambient lighting element, the method comprising acts of:

identifying a category of data being rendered by a host;

retrieving ambient lighting data associated with the identified category; and rendering the retrieved ambient lighting data in correspondence with the rendered data, wherein said method further comprises an act of:

editing an association of a category with ambient lighting data, and wherein the act of retrieving the ambient lighting data comprises an act of retrieving the ambient lighting data in accordance with the edited association.

7. The method as claimed in claim 1, wherein the association of the category to the retrieved ambient lighting data is a default association.

8. A non-transitory computer-readable medium having stored thereon an application configured to control an ambient lighting element, the application comprising:

a portion configured to identify a category of data being rendered by a host, wherein the identified category conveys (i) general information related to the data, as well as (ii) more detailed information related to a sub-category;

a portion configured to retrieve ambient lighting data associated with the identified category, wherein retrieving ambient lighting data further includes retrieving additional ambient lighting data associated with the sub-category; and a portion configured to render the retrieved ambient lighting data in correspondence with the rendered data, wherein rendering the retrieved ambient lighting data further includes modifying the retrieved ambient lighting data with the additional ambient lighting data associated with the sub-category.

9. The non-transitory computer-readable medium as claimed in claim 8, wherein the application further comprises a portion configured to receive user input to associate the ambient lighting data with the category.

10. A non-transitory computer-readable medium having stored thereon an application configured to control an ambient lighting element, the application comprising:

a portion configured to identify a category of data being rendered by a host;

a portion configured to retrieve ambient lighting data associated with the identified category; and a portion configured to render the retrieved ambient lighting data in correspondence with the rendered data, wherein the application further comprises a portion configured to identify a sub-category of the data, wherein the portion configured to retrieve comprises a portion configured to modify the retrieved ambient lighting data with additional ambient lighting data associated with the sub-category.

11. A non-transitory computer-readable medium having stored thereon an application configured to control an ambient lighting element, the application comprising:

a portion configured to identify a category of data being rendered by a host;

a portion configured to retrieve ambient lighting data associated with the identified category; and a portion configured to render the retrieved ambient lighting data in correspondence with the rendered data, wherein the application further comprises a portion configured to edit an association of a category with ambient lighting data, and wherein the portion configured to retrieve comprises a portion configured to retrieve the ambient lighting data in accordance with the edited association.

12. The non-transitory computer-readable medium as claimed in claim 8, wherein the application is configured to have a default association of the category to the retrieved ambient lighting data.

13. A device for controlling an ambient lighting element, the device comprising:

a memory; and a processor operationally coupled to the memory, wherein the processor is configured to:

identify a category of data being rendered by a host, wherein the identified category conveys (i) general information related to the data, as well as (ii) more detailed information related to a sub-category;

retrieve ambient lighting data associated with the identified category, wherein retrieving ambient lighting data further includes retrieving additional ambient lighting data associated with the sub-category; and render the retrieved ambient lighting data in correspondence with the rendered data, wherein rendering the retrieved ambient lighting data further includes modifying the retrieved ambient lighting data with the additional ambient lighting data associated with the sub-category.

14. The device as claimed in claim 13, wherein the processor is configured to render an ambient light script as the ambient lighting data.

15. The device as claimed in claim 13, wherein the processor is configured to associate the ambient lighting data with the category in response to a user interaction.

16. The device as claimed in claim 13, wherein the device is incorporated into a host that has additional functionality.

17. A device for controlling an ambient lighting element, the device comprising:

a memory; and a processor operationally coupled to the memory, wherein the processor is configured to:

identify a category of data being rendered by a host;

retrieve ambient lighting data associated with the identified category; and render the retrieved ambient lighting data in correspondence with the rendered data, wherein the processor is configured to identify a sub-category of the data, and to modify the retrieved ambient lighting data with additional ambient lighting data associated with the sub-category.

18. The device as claimed in claim 13, wherein the processor is configured to provide a default association of a category to ambient lighting data.

* * * * *